US008384277B2

(12) United States Patent
Yamada et al.

(10) Patent No.: US 8,384,277 B2
(45) Date of Patent: Feb. 26, 2013

(54) SPARK PLUG WITH AN IDENTIFIER

(75) Inventors: Yuichi Yamada, Niwa-gun (JP); Hiroaki Kuki, Nagoya (JP); Takashi Sano, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 156 days.

(21) Appl. No.: 12/974,658

(22) Filed: Dec. 21, 2010

(65) Prior Publication Data

US 2011/0148273 A1 Jun. 23, 2011

(30) Foreign Application Priority Data

Dec. 21, 2009 (JP) ..... 2009-288658
Sep. 29, 2010 (JP) ..... 2010-218203

(51) Int. Cl.
*F02M 57/06* (2006.01)
*H01T 13/20* (2006.01)

(52) U.S. Cl. ..... 313/118; 131/141

(58) Field of Classification Search ..... None
See application file for complete search history.

(56) References Cited

U.S. PATENT DOCUMENTS 5,563,468 A * 10/1996 Abe et al. ..... 313/141
5,976,674 A 11/1999 Sugimoto et al.
6,170,451 B1 * 1/2001 Moriya ..... 123/169 PA
6,214,150 B1 4/2001 Sugimoto et al.

FOREIGN PATENT DOCUMENTS

JP 58-154550 U 10/1983
JP A-09-277692 10/1997
JP 11-184615 A 7/1999
JP 2004-92410 A 3/2004

OTHER PUBLICATIONS

Office Action of the corresponding Japanese Application No. 2010-218203 mailed Jun. 26, 2012.

* cited by examiner

*Primary Examiner* — Anh Mai
*Assistant Examiner* — Britt D Hanley
(74) *Attorney, Agent, or Firm* — Leason Ellis LLP.

(57) ABSTRACT

A spark plug includes an insulator having an axial hole extending in the direction of an axis, and a terminal electrode disposed at a rear end portion of the axial hole. An identifier bearing externally visible identification information is joined to the rear end surface of the terminal electrode. The identifier has a thickness of 0.03 mm or greater along the direction of the axis.

13 Claims, 6 Drawing Sheets

SPARK PLUG WITH AN IDENTIFIER

CROSS-REFERENCE TO PRIOR APPLICATIONS

This is a U.S. non-provisional application which claims the benefit of Japanese Application No. 2009-288658, filed Dec. 21, 2009 and Japanese Application No. 2010-218203, filed Sep. 29, 2010. All preceding applications are incorporated herein by reference in their entirety.

TECHNICAL FIELD

The present invention relates to a spark plug for use in an internal combustion engine or the like and to a method of manufacturing the same.

BACKGROUND OF THE INVENTION

A spark plug is mounted to, for example, an internal combustion engine or a like combustion apparatus, and is used to ignite an air-fuel mixture in a combustion chamber. Generally, the spark plug includes an insulator having an axial hole; a center electrode inserted into a front end portion of the axial hole of the insulator; a terminal electrode inserted into a rear end portion of the axial hole of the insulator; a metallic shell externally assembled to the insulator; and a ground electrode extending from a front end portion of the metallic shell and forming, in cooperation with the center electrode, a spark discharge gap therebetween.

According to general practice, in order to allow external identification of a product No. or the like of the spark plug, a predetermined identifier is engraved on the metallic shell or printed on the surface of an insulator (refer to, for example, Patent Document 1). However, in the case where a plurality of spark plugs are contained in an array in a case, difficulty is encountered in visually checking the identifiers. In order to allow, even in such a case, easy checking of the identifiers marked on the spark plugs, there is proposed provision of an identifier on the rear end surface of the terminal electrode. Conceivably, an identifier is provided such that the identifier is marked by painting or printing.

Patent Document

[Patent Document 1] Japanese Patent Application Laid-Open (kokai) No. H09-277692

SUMMARY OF THE INVENTION

Problems to be Solved by the Invention

However, painting or printing an identifier is apt to involve a problem in that, for example, paint is applied patchily, or applied paint comes off; also, applied paint may suffer non-uniform color tone. Accordingly, the identifier may fail to exhibit sufficient identifiability. In order to sufficiently ensure the identifiability of an identifier, a provided identifier must be inspected. However, additional employment of an inspection step leads to a bloated production process, potentially resulting in deterioration in productivity.

The present invention has been conceived in view of the above circumstances, and an object of the invention is to provide a spark plug which allows improvement of identifiability of its identifier without involvement of deterioration in productivity, as well as a method of manufacturing the same.

Means for Solving the Problems

Configurations suitable for solving the above problems will next be described in itemized form. If needed, actions and effects peculiar to the configurations will be described additionally.

Configuration 1: A spark plug of the present configuration comprises an insulator having an axial hole extending in a direction of an axis, and a terminal electrode disposed at a rear end portion of the axial hole. The spark plug is characterized in the following: an identifier showing externally visible identification information is joined to a rear end surface of the terminal electrode, and the identifier has a thickness of 0.03 mm or greater along the direction of the axis.

The "identification information" indicates, directly or indirectly, information peculiar to a spark plug, such as product No. and size.

According to configuration 1 mentioned above, the identifier is joined (bonded, welded, or fused) to the rear end surface of the terminal electrode. Therefore, as compared with the case where an identifier is formed by painting or printing, which potentially involves a problem in that paint is applied patchily, or applied paint comes off, such a problem is not involved. As a result, the identifiability of the identifier can be improved without need to additionally employ an inspection step; i.e., without involvement of deterioration in productivity.

When the thickness of the identifier along the direction of the axis is less than 0.03 mm, identifiability may deteriorate, or even a slight flaw in the identifier may cause deformation of the identifier. Therefore, the thickness of the identifier along the direction of the axis must be 0.03 mm or greater.

Configuration 2: A spark plug of the present configuration is characterized in that, in configuration 1 mentioned above, the identifier has a thickness of 0.2 mm or greater along the direction of the axis.

Configuration 2 mentioned above ensures a thickness of the identifier of 0.2 mm or greater along the direction of the axis. Thus, identifiability can be further improved, and durability against flaws can be enhanced.

Configuration 3: A spark plug of the present configuration is characterized in that, in configuration 1 or 2 mentioned above, the identifier is formed of an electrically conductive resin or an electrically conductive rubber.

According to configuration 3 mentioned above, an electrically conductive resin or an electrically conductive rubber is used to form the identifier; therefore, the identifier is electrically conductive. Thus, the present configuration can prevent an excessive increase in resistance of the spark plug, which could otherwise result from the presence of the identifier. As a result, deterioration in ignition performance of the spark plug can be more reliably prevented.

Configuration 4: A spark plug of the present configuration is characterized in that, in any one of configurations 1 to 3 mentioned above, the identifier has a thickness of 1.0 mm or less.

Configuration 4 mentioned above specifies a thickness of the identifier of 1.0 mm or less, whereby contact of the identifier with the terminal electrode can be further improved. As a result, separation of the identifier can be more reliably prevented.

Configuration 5: A spark plug of the present configuration is characterized in that, in configuration 1 mentioned above, the identifier is formed of a metal material.

According to configuration 5 mentioned above, the identifier is formed of a metal material, thereby more reliably preventing an increase in resistance of the spark plug, which could otherwise result from the presence of the identifier. As a result, deterioration in ignition performance can be more reliably prevented.

Configuration 6: A spark plug of the present configuration is characterized in that, in configuration 5 mentioned above, the identifier is formed of a material having a color different from that of the rear end surface of the terminal electrode.

According to configuration 6 mentioned above, the identifier is formed of a material having a color different from that of the rear end surface of the terminal electrode. Thus, the identifiability of the identifier can be further improved.

Configuration 7: A spark plug of the present configuration is characterized in that, in any one of configurations 1 to 6 mentioned above, the identifier has a resistance of 1.5 kΩ or less as measured between the terminal electrode and a rear surface of the identifier opposite a surface of the identifier joined to the terminal electrode.

According to configuration 7 mentioned above, a sufficiently low resistance; i.e., 1.5 kΩ or less, is specified for the identifier. Therefore, deterioration in ignition performance can be more effectively prevented.

In view of restraint of deterioration in ignition performance, the lower the resistance of the identifier, the more preferred. Therefore, more preferably, the resistance of the identifier is 1.0 kΩ or less.

Configuration 8: A spark plug of the present configuration is characterized in that, in any one of configurations 1 to 7, when the identifier and the rear end surface of the terminal electrode are projected along the axis onto a plane of projection, as viewed on the plane of projection, an area S1 ($mm^2$) of a projected image of the rear end surface of the terminal electrode and an area S2 ($mm^2$) of a projected image of the identifier satisfy a relation represented by $0.2 \leqq S2/S1 \leqq 1.0$.

According to configuration 8 mentioned above, the terminal electrode and the identifier are configured such that the relation $0.2 \leqq S2/S1 \leqq 1.0$ is satisfied, where S1 ($mm^2$) is the area of a projected image of the rear end surface of the terminal electrode, and S2 ($mm^2$) is the area of a projected image of the identifier. That is, the identifier has a sufficiently large area in relation to the area of the rear end surface of the terminal electrode, and the identifier is joined to the rear end surface of the terminal electrode in such a manner as not to protrude from the rear end surface. Therefore, the identifiability of the identifier can be further improved.

Configuration 9: A spark plug of the present configuration is characterized in that, in any one of configurations 1 to 8, the identifier has a Vickers hardness of 150 Hv or less.

According to configuration 9 mentioned above, a Vickers hardness of 150 Hv or less is specified for the identifier. Thus, deformation of the identifier along the rear end surface of the terminal electrode is facilitated, thereby enhancing the performance of joining of the identifier. As a result, separation of the identifier can be more reliably prevented.

Configuration 10: A spark plug of the present configuration is characterized in that, in any one of configurations 1 to 9, when the identifier is sectioned along the axis, as viewed on the section, the rear surface of the identifier opposite the surface of the identifier joined to the terminal electrode, and a side surface of the identifier extending along the direction of the axis are orthogonal to each other, or the rear surface and the side surface are continuous with each other via a curved surface portion having a radius of curvature of 0.3 mm or less.

According to configuration 10 mentioned above, the identifier is configured such that the back and side surfaces of the identifier define a sharp edge. Therefore, particularly when mechanical means is used to recognize the identifier, the mechanical means can recognize the shape of the identifier more easily and reliably. As a result, the identifiability of the identifier can be further improved.

Configuration 11: A spark plug of the present configuration is characterized in that, in any one of configurations 1 to 10, the identifiers in a quantity of more than one are joined to the rear end surface of the terminal electrode.

According to configuration 11 mentioned above, the amount of information obtained from the identifiers can be easily increased. As compared with the case where the identifier is formed by painting, the identifier can be formed into a more complicated shape and can be formed more easily.

Configuration 12: A spark plug of the present configuration is characterized in the following: in any one of configurations 1 to 11 mentioned above, the identifier has a convex or concave engagement portion provided on the surface of the identifier joined to the terminal electrode; the terminal electrode has a concave or convex counter engagement portion provided on the rear end surface of the terminal electrode for engagement with the engagement portion; and the identifier is joined to the rear end surface of the terminal electrode in a condition in which the engagement portion is engaged with the counter engagement portion for positioning of the identifier in relation to the rear end surface of the terminal electrode.

According to configuration 12 mentioned above, when the identifier is to be joined to the terminal electrode, the engagement portion of the identifier is engaged with the counter engagement portion of the terminal electrode, whereby the identifier can be positioned in relation to the rear end surface of the terminal electrode. Therefore, the identifier can be joined to the terminal electrode at a desired position more easily and more accurately.

Configuration 13: A spark plug manufacturing method of the present configuration manufactures the spark plug according to any one of configurations 1 to 12 and comprises an identifier manufacturing step of manufacturing the identifier, and a joining step of joining the identifier to the rear end surface of the terminal electrode.

Configuration 13 mentioned above embodies the technical concept of configurations 1 to 11 mentioned above in a method of manufacturing a spark plug. Thus, configuration 13 yields actions and effects similar to those yielded by configurations 1 to 11.

MODES FOR CARRYING OUT THE INVENTION

First Embodiment

Figure 1:
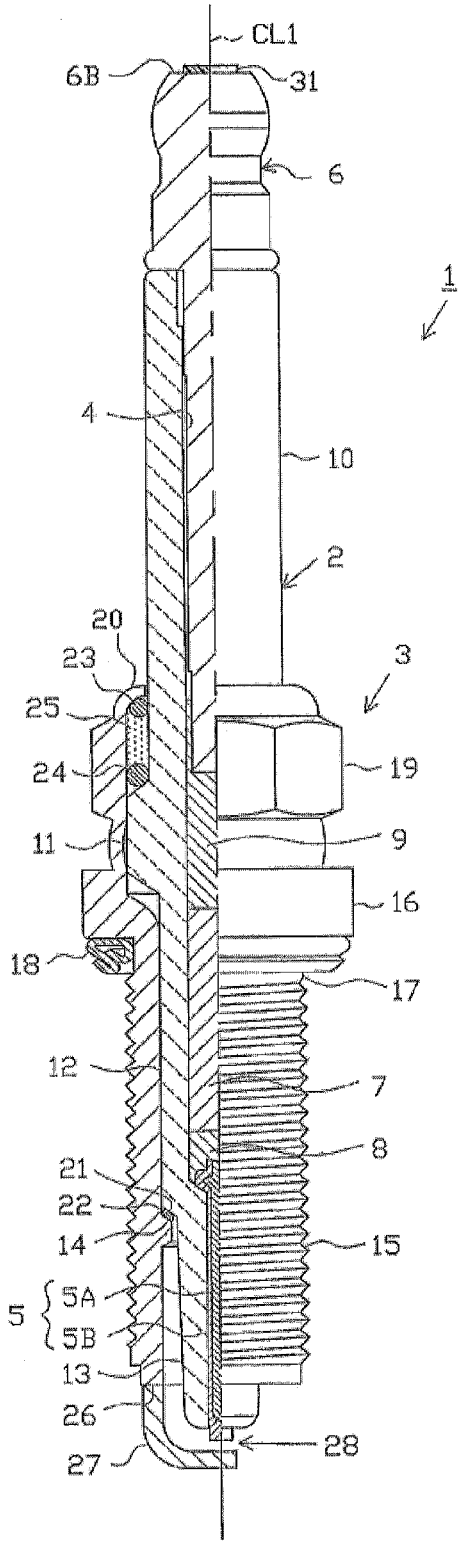
FIG. 1 Partially cutaway front view showing the configuration of a spark plug.

A first embodiment of the present invention will next be described with reference to the drawings. FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes an insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and most of the leg portion 13 are accommodated in the metallic shell 3. A tapered, stepped portion 14 is formed at a connection portion between the leg portion 13 and the intermediate trunk portion 12. The insulator 2 is seated on the metallic shell 3 at the stepped portion 14.

The insulator 2 has an axial hole 4 extending therethrough along the axis CL1. A center electrode 5 is fixedly inserted into a front end portion of the axial hole 4. The center electrode 5 includes an inner layer 5A made of copper or a copper alloy, and an outer layer 5B made of an Ni alloy which contains nickel (Ni) as a main component. The center electrode 5 assumes a rodlike (circular columnar) shape as a whole; has a flat front end surface; and projects from the front end of the insulator 2.

A terminal electrode 6 formed of low-carbon steel (e.g., chromium molybdenum steel) is fixedly inserted into a rear end portion of the axial hole 4 and projects from the rear end of the insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or a like metal. The metallic shell 3 has a threaded portion (externally threaded portion) 15 on its outer circumferential surface. The threaded portion 15 is adapted to mount the spark plug 1 to a combustion apparatus, such as an internal combustion engine or a fuel cell reformer. The metallic shell 3 has a seat portion 16 formed on its outer circumferential surface and located rearward of the threaded portion 15. A ring-like gasket 18 is fitted to a screw neck 17 located at the rear end of the threaded portion 15. Also, the metallic shell 3 has a tool engagement portion 19 provided near its rear end. The tool engagement portion 19 has a hexagonal cross section and allows a tool such as a wrench to be engaged therewith when the spark plug 1 is to be attached to the combustion apparatus. Further, the metallic shell 3 has a crimp portion 20 provided at its rear end portion and adapted to hold the insulator 2.

Also, the metallic shell 3 has a tapered, stepped portion 21 provided on its inner circumferential surface and adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimp portion 20 is formed, whereby the insulator 2 is fixed in place. An annular sheet packing 22 intervenes between the stepped portions 14 and 21 of the insulator 2 and the metallic shell 3, respectively. This retains gastightness of a combustion chamber and prevents leakage of air-fuel mixture to the exterior of the spark plug 1 through a clearance between the inner circumferential surface of the metallic shell 3 and the leg portion 13 of the insulator 2, which leg portion 13 is exposed to the combustion chamber.

Further, in order to ensure gastightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the insulator 2 via the sheet packing 22, the ring members 23 and 24, and the talc 25.

A ground electrode 27 is joined to a front end portion 26 of the metallic shell 3. A substantially intermediate portion of the ground electrode 27 is bent such that a side surface of a distal end portion of the ground electrode 27 faces a front end portion of the center electrode 5. A spark discharge gap 28 is formed between the front end portion of the center electrode 5 and the distal end portion of the ground electrode 27. Spark discharges are generated across the spark discharge gap 28 substantially along the axis CL1.

Figure 2A:
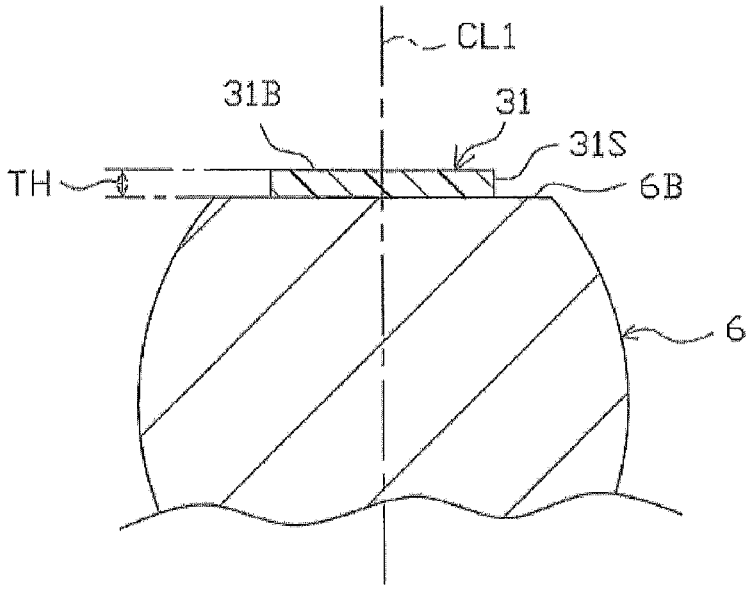
FIG. 2A Enlarged sectional partial view showing an identifier and a terminal electrode.
Figure 2B:
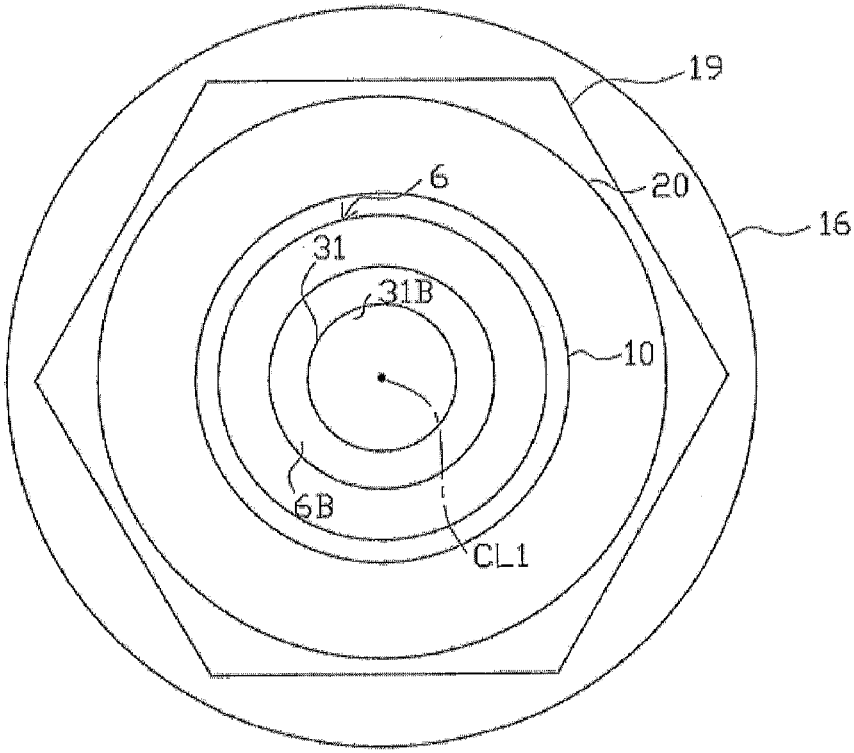
FIG. 2B Enlarged plan view showing the identifier, the terminal electrode, etc.

Further, in the present embodiment, as shown in FIGS. 2A and 2B, an identifier 31 is joined to a rear end surface 6B of the terminal electrode 6. The identifier 31 assumes the form of a disk and bears externally visible identification information (not shown). The "identification information" indicates, directly or indirectly, information peculiar to a spark plug, such as product No. and size.

The identifier 31 is formed of an electrically conductive resin having predetermined heat resistance (e.g., a mixture of resin, such as silicone resin, fluorine-containing resin, or glass-fiber-containing nylon, and an electrically conductive metal, such as copper or silver). Thus, the identifier 31 has a resistance of 1.5 kΩ or less as measured between the terminal electrode 6 and a rear surface 31B of the identifier 31 opposite the surface of the identifier 31 joined to the terminal electrode 6. Also, the identifier 31 has a Vickers hardness of 150 Hv or less (e.g., 100 Hv or less). The identifier 31 may be formed of electrically conductive rubber having predetermined heat resistance (e.g., a formed product of a mixture of silicone rubber or fluororubber, and copper powder or carbon powder).

The resistance between the terminal electrode 6 and the rear surface 31B of the identifier 31 can be measured by use of a resistance meter (e.g., DIGITAL HiTESTER 3237, product of HIOKI) as follows: test terminals of the resistance meter are brought into contact with the rear surface 31B and the terminal electrode 6, respectively.

The thickness TH of the identifier 31 along the axis CL1 is 0.03 mm to 1.0 mm inclusive (more preferably, 0.2 mm to 1.0 mm inclusive). When the thickness of the identifier 31 is not uniform; for example, when the identifier 31 has some irregularities, the "thickness TH" refers to the thickness of a thinnest portion of the identifier 31. The size of the identifier 31 is determined such that, as viewed on a plane of projection onto which the identifier 31 and the rear end surface 6B of the terminal electrode 6 are projected along the axis CL1, the area S1 ($mm^2$) of a projected image of the rear end surface 6B of the terminal electrode 6 and the area S2 ($mm^2$) of a projected image of the identifier 31 satisfy a relation represented by $0.2 \leqq S2/S1 \leqq 1.0$.

Figure 3:
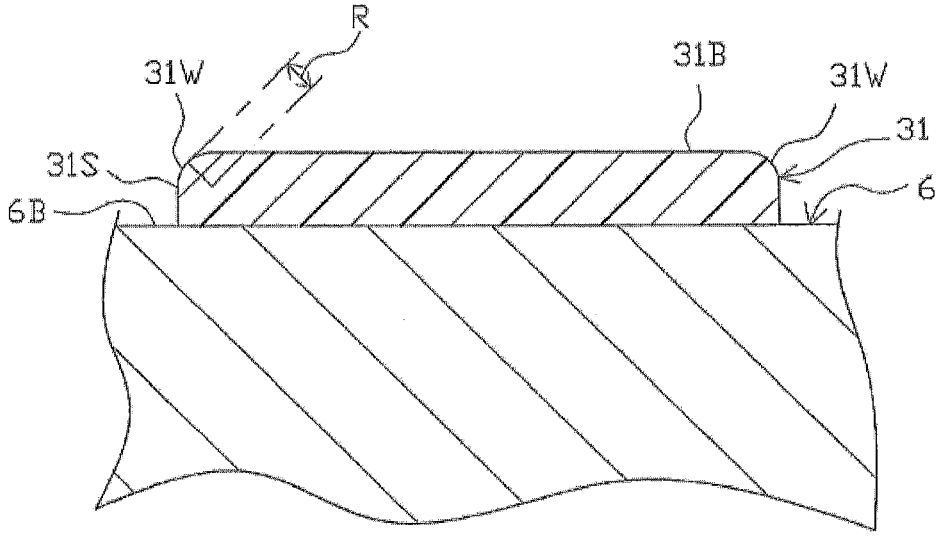
FIG. 3 Enlarged sectional partial view for explaining a curved surface portion of the identifier.

Additionally, in the present embodiment, the rear surface 31B of the identifier 31 and a side surface 31S of the identifier 31 extending along the direction of the axis CL1 are orthogonal to each other. Instead of the rear surface 31B and the side surface 31S being orthogonal to each other, as shown in FIG. 3, the rear surface 31B and the side surface 31S may be continuous with each other via a curved surface portion 31W. In this case, the curved surface portion 31W has a radius R of curvature of 0.3 mm or less.

Next, a method of manufacturing the spark plug 1 configured as mentioned above is described.

First, the metallic shell 3 is formed beforehand. Specifically, a circular columnar metal material (e.g., an iron-based material, such as S17C or S25C, or a stainless steel material) is subjected to cold forging or the like for forming a through hole and a general shape. Subsequently, machining is conducted so as to adjust the outline, thereby yielding a metallic-shell intermediate.

Then, the ground electrode 27 having the form of a rod and formed of an Ni alloy is resistance-welded to the front end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is joined is obtained. The surface of the metallic shell 3 is subjected to galvanization or nickel plating. In order to enhance corrosion resistance, the plated surface may be further subjected to chromate treatment.

Separately from preparation of the metallic shell 3, the insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is placed in a kiln, followed by firing for forming the insulator 2.

Separately from preparation of the metallic shell 3 and the insulator 2, the center electrode 5 is formed. Specifically, an Ni alloy prepared such that a copper alloy is disposed in a central portion thereof for enhancing heat radiation is subjected to forging, thereby forming the center electrode 5.

Further, an electrically conductive alloy, such as low-carbon steel, is subjected to forging, machining, etc., thereby forming the terminal electrode 6.

Next, in an identifier manufacturing step, the identifier 31 is manufactured. First, a resin plate having a thickness of 0.03 mm to 1.0 mm inclusive is fabricated from a resin material into which an electrically conductive metal, such as copper, is mixed. By use of a cylindrical blanking die, blanking is performed on the resin plate, thereby yielding the identifier 31 in a disk shape. The method of manufacturing the identifier 31 is not limited thereto. For example, resin powder mixed with metal powder may be subjected to compression molding for yielding the identifier 31.

Subsequently, in a joining step, the thus-yielded identifier 31 is joined to the rear end surface 6B of the terminal electrode 6. Specifically, the identifier 31 is placed on the rear end surface 6B of the terminal electrode 6. Then, while load is applied to the rear surface 31B of the identifier 31, heat is applied to the identifier 31. By this procedure, the identifier 31 is fused to the rear end surface 6B of the terminal electrode 6. The identifier 31 may be bonded to the rear end surface 6B of the terminal electrode 6 by use of adhesive.

Next, the insulator 2, the center electrode 5, and the terminal electrode 6, which are formed as mentioned above, and the resistor 7 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the insulator 2 such that the resistor 7 is sandwiched therebetween. Subsequently, the resultant assembly is heated in a kiln while the charged mixture is pressed from the rear by the terminal electrode 6, thereby being fired and fixed. At this time, a glaze layer may be simultaneously fired on the surface of the rear trunk portion 10 of the insulator 2; alternatively, the glaze layer may be formed beforehand.

Subsequently, the thus-formed insulator 2 having the center electrode 5, the terminal electrode 6, etc., and the metallic shell 3 having the ground electrode 27 are assembled together. More specifically, a relatively thin-walled rear-end opening portion of the metallic shell 3 is crimped radially inward; i.e., the above-mentioned crimp portion 20 is formed, thereby fixing the insulator 2 and the metallic shell 3 together.

Finally, the ground electrode 27 is bent so as to face the center electrode 5, and the magnitude of the spark discharge gap 28 formed between the center electrode 5 and the ground electrode 27 is adjusted, thereby yielding the spark plug 1.

As described in detail above, according to the present embodiment, the identifier 31 having a thickness of 0.03 mm or greater is joined to the rear end surface 6B of the terminal electrode 6. Therefore, as compared with the case where an identifier is formed by painting or printing, which potentially involves a problem in that paint is applied patchily, or applied paint comes off, such a problem is not involved. As a result, the identifiability of the identifier 31 can be improved without need to additionally employ an inspection step; i.e., without involvement of deterioration in productivity.

Also, the identifier 31 is formed of an electrically conductive resin or an electrically conductive rubber so as to have a resistance of 1.5 kΩ or less. Therefore, the use of the identifier 31 can prevent an excessive increase in resistance of the spark plug 1, which could otherwise result from the presence of the identifier 31, so that deterioration in ignition performance can be more reliably prevented.

Additionally, since the identifier 31 has a thickness of 1.0 mm or less, contact of the identifier 31 with the terminal electrode 6 can be further improved. As a result, separation of the identifier 31 can be more reliably prevented.

Further, the terminal electrode 6 and the identifier 31 are configured to satisfy the relation represented by $0.2 \leqq S2/S1 \leqq 1.0$. That is, the identifier 31 has a sufficiently large area in relation to the area of the rear end surface 6B of the terminal electrode 6, and the identifier 31 is joined to the rear end surface 6B of the terminal electrode 6 in such a manner as not to protrude from the rear end surface 6B. Therefore, the identifiability of the identifier 31 can be further improved.

In addition, a Vickers hardness of 150 Hv or less is specified for the identifier 31. Thus, deformation of the identifier 31 along the rear end surface 6B of the terminal electrode 6 is facilitated, thereby enhancing the performance of joining of the identifier 31. As a result, separation of the identifier 31 can be more reliably prevented.

Also, the identifier 31 is configured such that the back surface 31B and the side surface 31S of the identifier 31 define a sharp edge. Therefore, particularly when mechanical means is used to recognize the identifier 31, the mechanical means can recognize the shape of the identifier 31 more easily and reliably. As a result, the identifiability of the identifier 31 can be further improved.

Second Embodiment

Next, a second embodiment of the present invention will be described, centering on points of difference from the first embodiment described above.

Figure 4:
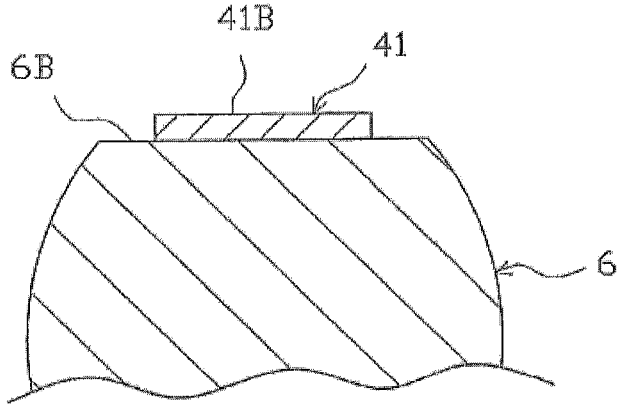
FIG. 4 Enlarged sectional partial view for explaining an identifier in a second embodiment of the present invention.

In the second embodiment, as shown in FIG. 4, an identifier 41 is formed of a metal material having a color different from that of the rear end surface 6B of the terminal electrode 6. For example, in the case where the terminal electrode 6 is formed of low-carbon steel, the surface of the terminal electrode 6 is gray in color; thus, the metal material can be copper or brass, whose color differs from gray. The identifier 41 may be such that at least its region (surface) opposite its surface fixed to the terminal electrode 6 is formed of a metal material having a different color from the rear end surface of the terminal electrode 6. The expression "different color" means that, for example, when the HSV color space is used to express the color of the identifier 41 and that of the rear end surface of the terminal electrode 6, the identifier 41 differs from the rear end surface of the terminal electrode 6 in hue by ±45° or greater, or the identifier 41 differs from the rear end surface of the terminal electrode 6 in lightness by ±20% or more.

The identifier 41 in the second embodiment is thinner in thickness than the identifier 31 in the first embodiment. However, the thickness of the identifier 41 is 0.03 mm or greater.

Additionally, the identifier 41 is joined to the rear end surface 6B of the terminal electrode 6 as follows. A separately manufactured identifier 41 is placed on the rear end surface 6B of the terminal electrode 6. While pressure is applied to the identifier 41 by means of a predetermined welding electrode rod, current is applied to the identifier 41. That is, the identifier 41 is joined to the rear end surface 6B of the terminal electrode 6 by resistance welding.

Thus, basically, the second embodiment yields actions and effects similar to those yielded by the first embodiment described previously.

Additionally, since the identifier 41 is formed of a metal material, there can be more reliably prevented an increase in resistance of the spark plug 1, which could otherwise result from the presence of the identifier 41. As a result, deterioration in ignition performance can be more reliably prevented.

Also, since the identifier 41 is formed of a material having a color different from that of the rear end surface 6B of the terminal electrode 6, the identifiability of the identifier 41 can be further improved.

Next, in order to verify actions and effects yielded by the above embodiments, spark plug samples were fabricated and classified into Sample 1 (Example), Sample 2 (Example), and Sample 3 (Comparative Example), 200 samples each. In Sample 1, the identifier formed of an electrically conductive resin was joined to the terminal electrode. In Sample 2, the identifier formed of copper was joined to the terminal electrode. In Sample 3, the identifier was painted on the terminal electrode. The samples of Samples 1, 2, and 3 were subjected to an identifiability evaluation test. The outline of the identifiability evaluation test is as follows. An LED ring light (CA-DRW3, product of Keyence Corporation) was disposed 0.1 m rearward of the rear end of each of the samples for illuminating the rear end surface of the terminal electrode. In this condition, the rear end surface of the terminal electrode was image-captured by a CCD camera (CV-3000, product of Keyence Corporation), whereby an image consisting of a predetermined number of pixels was captured. The thus-captured image was binarized for recognizing the shape of peripheral edge of the identifier. The recognized shape of the identifier was compared with the previously stored reference shape of the identifier, thereby obtaining shape match percentages for the 200 samples of each of Samples 1, 2, and 3. Samples having a shape match percentage of 85% or higher were judged acceptable. The percentage of accepted samples in the 200 samples (percentage of acceptance) was calculated for each of Samples 1, 2, and 3. Table 1 shows the results of the identifiability evaluation test. The samples had a thickness of the identifier of 0.03 mm, a nominal thread diameter of the threaded portion of M14, and a nominal size of the tool engagement portion of HEX16.

TABLE 1

| | Percentage of acceptance (%) |
|---|---|
| Sample 1 | 91 |
| Sample 2 | 94 |
| sample 3 | 85 |

As shown in Table 1, Sample 3 of Comparative Example, in which the identifier is formed by painting, shows a relatively low percentage of acceptance of less than 90%, indicating poor identifiability. Conceivably, this is for the following reason. Since the identifiers were formed by painting, the identifiers were painted patchily, or a like problem arose; as a result, difficulty was encountered in recognizing the shapes of the identifiers.

By contrast, Samples 1 and 2, in which the identifier formed of an electrically conductive resin or copper and having a thickness of 0.03 mm is joined to the terminal electrode, exhibit a percentage of acceptance in excess of 90%, indicating excellent identifiability. Conceivably, this is for the following reason. Since the separately formed identifiers were joined to the terminal electrodes, patchy outlines of the identifiers or a like problem was unlikely to arise.

Next, spark plug samples were fabricated such that the identifiers formed of an electrically conductive resin and having different thicknesses were joined to respective terminal electrodes, 10 samples for each of the thicknesses. The samples were subjected to the identifiability evaluation test mentioned above. When all of 10 samples having a certain identifier thickness exhibited a shape match percentage of 85% or higher, the samples were evaluated as "Good," indicating that the samples exhibit good identifiability. When all of 10 samples having a certain identifier thickness exhibited a shape match percentage of 90% or higher, the samples were evaluated as "Excellent," indicating that the samples exhibit excellent identifiability. When 10 samples having a certain identifier thickness contained a sample(s) which exhibited a shape match percentage of less than 85%, the samples were evaluated as "Poor," indicating that the samples exhibit poor identifiability (i.e., the present identifiability evaluation test employed a more severe evaluation criterion than did the aforementioned identifiability evaluation test). Table 2 shows the relationship between the identifier thickness and test results. The samples had a nominal thread diameter of the threaded portion of M14, a nominal size of the tool engagement portion of HEX16, and an outside diameter of the identifier of 0.3 mm.

TABLE 2

| Thickness of identifier (mm) | Identifiability |
|---|---|
| 0.05 | Poor |
| 0.10 | Poor |
| 0.20 | Good |
| 0.30 | Excellent |
| 0.40 | Excellent |
| 0.50 | Excellent |
| 0.75 | Excellent |
| 1.00 | Excellent |
| 1.25 | Excellent |
| 1.50 | Excellent |

As shown in Table 2, the samples having an identifier thickness of less than 0.2 mm exhibit rather insufficient identifiability. Conceivably, this is for the following reason. Since the identifiers were relatively thin, difficulty was encountered in recognizing the shapes of the peripheries of the identifiers.

By contrast, the samples having an identifier thickness of 0.2 mm or greater exhibit good identifiability. Conceivably, this is for the following reason: since the identifiers had sufficient thicknesses, recognizing the shapes of the identifiers was relatively easy. Particularly, the samples having an identifier thickness of 0.3 mm or greater were confirmed to exhibit excellent identifiability.

Next, spark plug samples were fabricated such that the identifiers formed of an electrically conductive resin and having different resistances were joined to respective terminal electrodes. The samples were subjected to an ignition-performance evaluation test. The outline of the ignition-performance evaluation test is as follows. The samples were mounted to a 1.5 L 4-cylinder gasoline engine. The engine was operated at a speed of 2,000 rpm under no load. In the course of gradual increase in air-fuel ratio (A/F) (as the percentage of fuel in the air-fuel mixture is gradually lowered), an air-fuel ratio at which, among 1,000 cycles, 10 or more cycles suffered misfire was defined as a critical air-fuel ratio. The samples having a critical air-fuel ratio of 16 or greater were evaluated as "Good," indicating that the samples have good ignition performance. The samples having a critical air-fuel ratio of 17 or greater were evaluated as "Excellent," indicating that the samples have excellent ignition performance. The samples having a critical air-fuel ratio of less than 16 were evaluated as "Poor," indicating that the samples have poor ignition performance. Notably, a sample having a greater critical air-fuel ratio is less likely to suffer misfire even in a condition in which the percentage of fuel in the air-fuel mixture is low, and thus can be said to have better ignition performance. Table 3 shows the results of the ignition evaluation test. The samples had a nominal thread diameter of the threaded portion of M14, a nominal size of the tool engagement portion of HEX16, and an internal resistance (resistance between the rear end of the terminal electrode and the front end of the center electrode) of 5 kΩ.

TABLE 3

| Resistance of identifier (kΩ) | Ignition performance |
|---|---|
| 0.01 | Excellent |
| 0.05 | Excellent |
| 0.10 | Excellent |
| 0.50 | Excellent |
| 0.80 | Excellent |
| 1.00 | Excellent |
| 1.50 | Good |
| 2.00 | Poor |
| 3.00 | Poor |

As is apparent from Table 3, the samples having a resistance of the identifier in excess of 1.5 kΩ have poor ignition performance. Conceivably, this is for the following reason. In an environment in which the percentage of fuel is low, voltage required for the generation of a spark discharge (required voltage) increases. In association with the increase in the resistance of the identifier, the initial required voltage became relatively high. As a result, in the environment in which the required voltage was high, difficulty was encountered in generating a spark discharge.

By contrast, the samples having a resistance of the identifier of 1.5 kΩ or less were confirmed to have good ignition performance. Conceivably, this is for the following reason: since the resistance of the identifier was relatively low, the initial required voltage could be limited to a low level. Particularly, the samples having a resistance of the identifier of 1.0 kΩ or less were found to have excellent ignition performance.

Next, spark plug samples were fabricated such that the identifiers formed of an electrically conductive resin and having different thicknesses were fused to respective terminal electrodes. The samples were subjected to a bond-performance evaluation test. The outline of the bond-performance evaluation test is as follows. The samples were subjected to five test cycles, each consisting of heating the samples such that the terminal electrodes are heated to 100° C., and immersing the samples in water of 25° C. After the fifth immersion in water, the cross sections of the terminal electrodes and the identifiers were observed. Specifically, a separated portion of the fusion surface of each of the identifiers which was separated from the associated terminal electrode was measured for length. The percentage of the length of the separated portion to the length of the fusion surface (separation percentage) was calculated. The samples having a separation percentage of 0% to less than 20% were evaluated as "Excellent," indicating that the samples have excellent bond performance even in exposure to a severe thermal load. The samples having a separation percentage of 20% to 40% inclusive were evaluated as "Good," indicating that the samples have sufficient bond performance. The samples having a separation percentage in excess of 40% were evaluated as "Poor," indicating that the Samples have poor bond performance. Table 4 shows the results of the bond-performance evaluation test. The samples had a nominal thread diameter of the threaded portion of M14 and a nominal size of the tool engagement portion of HEX16.

TABLE 4

| Thickness of identifier (mm) | Bond performance |
|---|---|
| 0.05 | Excellent |
| 0.10 | Excellent |
| 0.20 | Excellent |
| 0.30 | Excellent |
| 0.40 | Excellent |
| 0.50 | Excellent |
| 0.75 | Excellent |
| 1.00 | Good |
| 1.25 | Poor |
| 1.50 | Poor |

As is apparent from Table 4, the samples having a thickness of the identifier in excess of 1.0 mm are apt to suffer separation of the identifiers. Conceivably, this is for the following reason. Since the identifiers were excessively thick, the identifiers expanded greatly under thermal load; as a result, large stresses were generated between the identifiers and the terminal electrodes.

By contrast, the samples having a thickness of the identifier of 1.0 mm or less are unlikely to suffer separation of the identifiers. Conceivably, this is for the following reason: since the identifiers were formed relatively thin, the expansion of the identifiers under thermal load could be limited to the greatest possible extent; as a result, stresses generated between the identifiers and the terminal electrodes could be reduced. Particularly, the samples having a thickness of the identifier of 0.75 mm or less were confirmed to have excellent bond performance.

Next, spark plug samples were fabricated such that, as viewed on a plane of projection onto which the identifier and the rear end surface of the terminal electrode were projected along the axis, the ratio of the area S2 ($mm^2$) of a projected image of the identifier to the area S1 ($mm^2$) of a projected image of the rear end surface of the terminal electrode (S2/S1) was varied by means of varying the size (area) of the identifier, 200 samples for each of the S2/S1 ratios. The samples were subjected to the identifiability evaluation test mentioned previously. In the test, samples having an aforementioned shape match percentage of 85% or higher were judged acceptable. The percentage of accepted samples in the 200 samples (percentage of acceptance) was calculated for each of the S2/S1 ratios. Samples having an S2/S1 ratio associated with a percentage of acceptance of 98% or higher were evaluated as "Excellent," indicating that the samples exhibit excellent identifiability. Samples having an S2/S1 ratio associated with a percentage of acceptance of 95% to less than 98% were evaluated as "Good," indicating that the samples exhibit good identifiability. Samples having an S2/S1 ratio associated with a percentage of acceptance of less than 95% were evaluated as "Fair," indicating that the samples exhibit fair identifiability. Table 5 shows the results of the identifiability evaluation test. The samples had a nominal thread diameter of the threaded portion of M14, a nominal size of the tool engagement portion of HEX16, and an area of the rear end surface of the terminal electrode of 19.5 $mm^2$.

TABLE 5

| S2/S1 | Identifiability |
|---|---|
| 0.05 | Fair |
| 0.10 | Fair |
| 0.20 | Good |
| 0.30 | Good |
| 0.40 | Excellent |
| 0.50 | Excellent |
| 0.60 | Excellent |
| 0.70 | Excellent |
| 0.80 | Good |
| 0.90 | Good |
| 1.00 | Good |

As is apparent from Table 5, the samples having an S2/S1 ratio of 0.2 to 1.0 inclusive exhibit good or excellent identifiability. Conceivably, this is for the following reason. Since the identifiers had sufficiently large areas in relation to the areas of the rear end surfaces of the terminal electrodes, the identifiers had sufficiently large sizes as viewed in captured images.

Also, the samples having an S2/S1 ratio of 0.4 to 0.7 inclusive were found to exhibit excellent identifiability. Conceivably, this is for the following reason. In addition to impartment of sufficiently large areas to the identifiers in relation to the areas of the rear end surfaces of the terminal electrodes, the employment of an S2/S1 ratio of 0.7 or less ensured the presence of certain distances between the peripheral edges of the identifiers and the peripheral edges of the terminal electrodes; as a result, recognizing the shapes of the identifiers was facilitated.

In the above test, while the value of S1 was held constant, the value of S2 was varied. Also, even in the case where the value of S1 is varied with the value of S2 held constant, test results similar to those of the above test are obtained through processing under the following conditions: captured images are held constant in the number of pixels, and the rear end surfaces of the terminal electrodes account for the same area percentage of the captured images.

Next, in order to verify the influence of hardness of the identifier on the performance of joining of the identifier to the rear end surface of the terminal electrode, spark plug samples were fabricated and classified into Samples A, B, and C. The samples were subjected to a performance-of-joining evaluation test. Specifically, the samples were observed for the cross section of the terminal electrode and the identifier, which were joined together. An unjoined portion of the joint surface of each of the identifiers which was not joined to the terminal electrode was measured for length. The percentage of the length of the unjoined portion to the length of the joint surface (unjoined percentage) was calculated. The samples having an unjoined percentage of 0% to less than 20% were evaluated as "Excellent," indicating that the samples have excellent performance of joining. The samples having an unjoined percentage of 20% to 40% inclusive were evaluated as "Good," indicating that the samples have sufficient performance of joining. The samples having an unjoined percentage in excess of 40% were evaluated as "Poor," indicating that the samples have poor performance of joining. Table 6 shows the results of the performance-of-joining evaluation test (in Table 6, the mark "-" indicates that the test was not conducted since manufacturing the identifiers having associated hardnesses was difficult).

The samples of Sample A were configured such that identifiers made of copper and having different hardnesses were resistance-welded (load: 500 N; current: 1.5 kA) to terminal electrodes whose rear end surfaces had a depression having a diameter of 2.5 mm and a depth of 0.1 mm at the center. The samples of Sample B were configured such that identifiers made of an electrically conductive resin and having different hardnesses were fused (load: 100 N; temperature of applied heat: 150° C.) to the terminal electrodes having the above-mentioned depression. The samples of Sample C were configured such that identifiers made of an electrically conductive rubber and having different hardnesses were fused (load: 100 N; temperature of applied heat: 150° C.) to the terminal electrodes having the above-mentioned depression. The samples had a nominal thread diameter of the threaded portion of M14, a nominal size of the tool engagement portion of HEX16, and a thickness of the identifier of 0.3 mm.

TABLE 6

| | Performance of joining | | |
|---|---|---|---|
| Hardness (Hv) | Sample A | Sample B | Sample C |
| 50 | — | Excellent | Excellent |
| 75 | — | Excellent | Excellent |
| 100 | Excellent | Excellent | Excellent |
| 125 | Excellent | — | — |
| 150 | Good | — | — |
| 175 | Poor | — | — |
| 200 | Poor | — | — |

As shown in Table 6, the samples having a Vickers hardness in excess of 150 Hv were confirmed to have poor performance of joining. Conceivably, this is for the following reason. Since hardness was excessively high, the identifiers were unlikely to deform; as a result, extreme difficulty was encountered in deforming the identifiers in such a manner as to follow the rear end surfaces of the terminal electrodes.

By contrast, the samples having a Vickers hardness of 150 Hv or less were found to have sufficient performance of joining. Particularly, the employment of a hardness of 100 Hv or less was found to implement excellent performance of joining. Conceivably, this is for the following reason. The employment of relatively low hardness allowed the identifiers to deform easily.

Next, spark plug samples were fabricated such that the identifiers had curved surface portions having different radii of curvature which were provided between the rear surfaces and the side surfaces of the identifiers, 200 samples for each of the radii of curvature. The samples were subjected to the identifiability evaluation test mentioned previously. In the test, samples having a shape match percentage of 85% or higher were judged acceptable. The percentage of accepted, samples in the 200 samples (percentage of acceptance) was calculated for each of the radii of curvature. Samples having a radius of curvature associated with a percentage of acceptance of 98% or higher were evaluated as "Excellent," indicating that the samples exhibit excellent identifiability. Samples having a radius of curvature associated with a percentage of acceptance of less than 98% were evaluated as "Fair," indicating that the samples exhibit relatively inferior identifiability. Table 7 shows the results of the identifiability evaluation test. The samples had a nominal thread diameter of the threaded portion of M14 and a nominal size of the tool engagement portion of HEX16. The identifiers were formed of an electrically conductive resin and had a thickness of 1.0 mm.

TABLE 7

| Radius of curvature (mm) | Identifiability |
|---|---|
| 0.05 | Excellent |
| 0.10 | Excellent |
| 0.20 | Excellent |
| 0.30 | Excellent |
| 0.40 | Fair |
| 0.50 | Fair |
| 0.75 | Fair |
| 1.00 | Fair |

As is apparent from Table 7, the samples having a radius of curvature of 0.3 mm or less exhibit excellent identifiability. Conceivably, this is for the following reason. Reduction of the radius of curvature allowed the mechanical means to recognize more easily the boundary between the identifier and the terminal electrode in a captured image; as a result, recognizing the shape of the identifier was facilitated.

In view of the test results mentioned above, in order to improve the identifiability of the identifier, preferably, the identifier formed separately is joined to the terminal electrode instead of the identifier being provided through painting or the like, and the identifier has a thickness of 0.03 mm or greater.

In order to further improve the identifiability of the identifier, more preferably, the identifier has a thickness of 0.2 mm or greater, and the S2/S1 ratio is 0.2 to 1.0 inclusive. Far more preferably, the identifier has a thickness of 0.3 mm or greater; the S2/S1 ratio is 0.4 to 0.7 inclusive; and the curved surface portion has a radius of curvature of 0.3 mm or less (including the case where the rear surface and the side surface of the identifier are orthogonal to each other).

Additionally, in order to reliably prevent deterioration in ignition performance, the identifier has a resistance of, preferably, 1.5 kΩ or less, more preferably 1.0 kΩ or less.

Also, in order to improve the performance of joining the identifier to the terminal electrode, preferably, the identifier has a thickness of 1.0 mm or less and a Vickers hardness of 150 Hv or less.

The present invention is not limited to the above-described embodiments, but may be embodied, for example, as follows. Of course, application examples and modifications other than those described below are also possible.

Figure 5A:
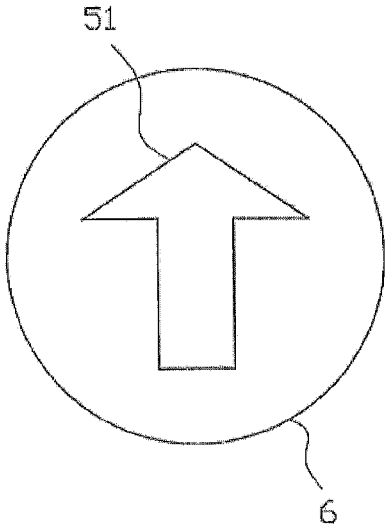
FIGS. 5A to 5D Enlarged plan views showing modified identifiers.
Figure 5B:
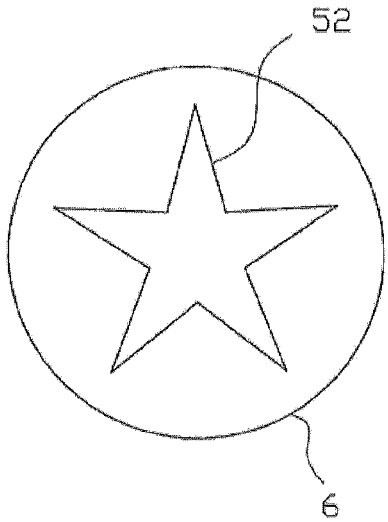
Figure 5C:
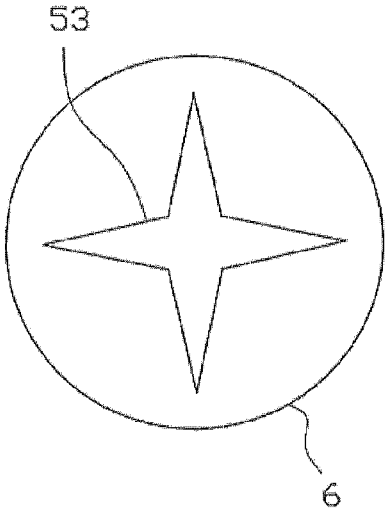
Figure 5D:
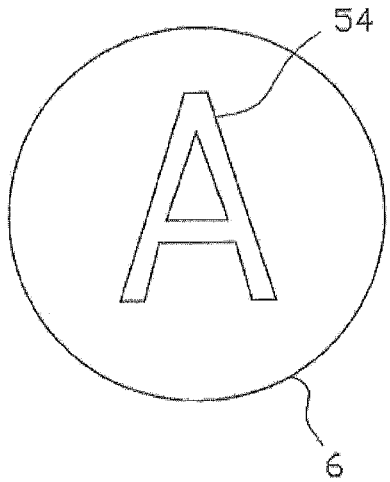

(a) In the embodiments described above, the identifier 31 (41) assumes the form of a disk. However, the shape of the identifier 31 (41) is not limited thereto. For example, as shown in FIG. 5A, an identifier 51 may be formed into the shape of an arrow; as shown in FIG. 5B, an identifier 52 may be formed into the shape of a star; or, as shown in FIG. 5C, an identifier 53 may be formed into the shape of a cross. Also, as shown in FIG. 5D, an identifier 54 may assume the form of a character or a symbol.

Figure 6A:
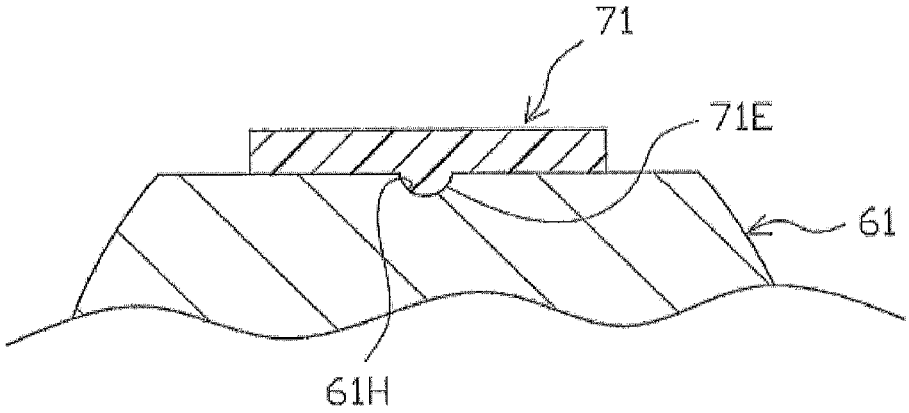
FIGS. 6A to 6C Enlarged sectional partial views for explaining modified engagement portions and modified counter engagement portions.
Figure 6B:
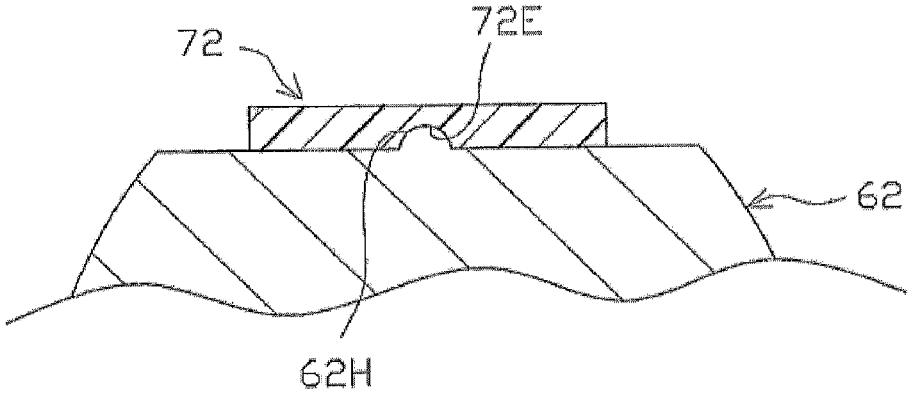
Figure 6C:
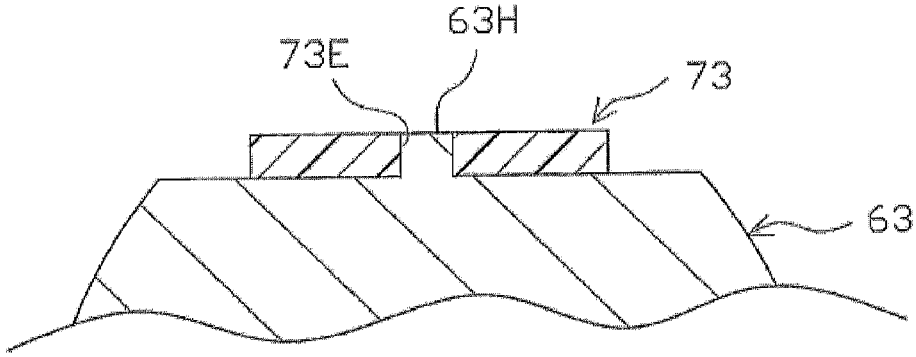

(b) In the embodiments described above, the rear end surface 6B of the terminal electrode 6 and the joint surface of the identifier 31 are flat. However, as shown in FIG. 6A, an identifier 71 and a terminal electrode 61 may be configured as follows: the identifier 71 has a convex engagement portion 71E, and the terminal electrode 61 has a concave counter engagement portion 61H; and the identifier 71 is joined to the terminal electrode 61 in a condition in which the engagement portion 71E is engaged with the counter engagement portion 61H for positioning of the identifier 71 in relation to the terminal electrode 61. In this case, the identifier 71 can be joined to the terminal electrode 61 at a desired position more easily and more accurately. As shown in FIG. 6B, an identifier 72 and a terminal electrode 62 may be configured as follows: the identifier 72 has a concave engagement portion 72E, and the terminal electrode 62 has a convex counter engagement portion 62H. Also, as shown in FIG. 6C, an identifier 73 and a terminal electrode 63 may be configured as follows: the identifier 73 has an engagement portion 73E in the form of a through hole extending between the joint surface and the rear surface of the identifier 73, and the terminal electrode 63 has a projecting counter engagement portion 63H to be inserted into the engagement portion 73E. Generally, since the rear end surface of the terminal electrode is slightly concaved, the joint surface of the identifier may be convexed according to the concave rear end surface.

Figure 7A:
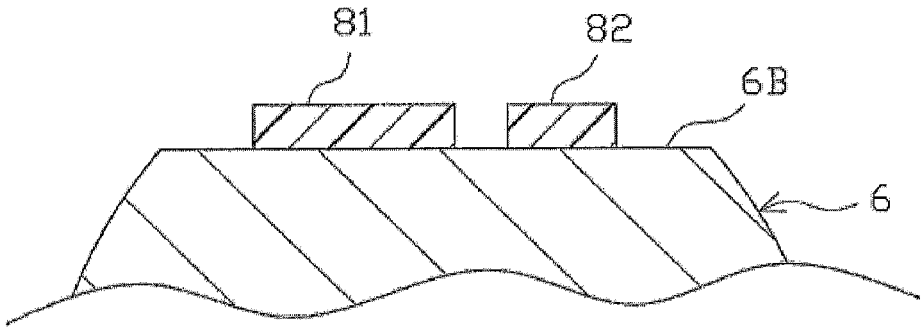
FIGS. 7A and 7B Enlarged sectional partial views showing further modified identifiers.
Figure 7B:
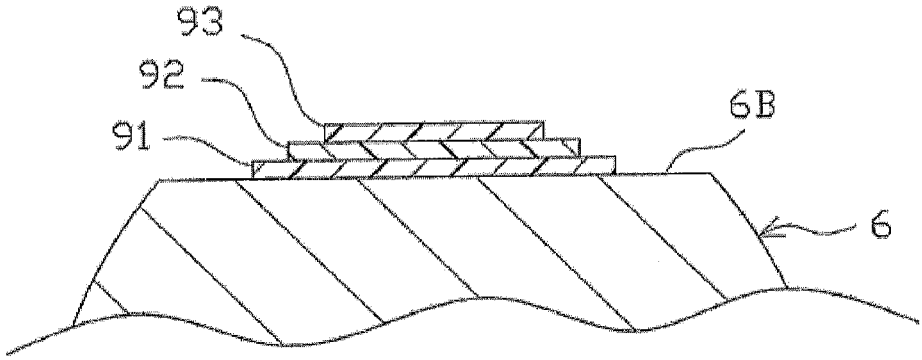

(c) In the embodiments described above, a single identifier 31 (41) is joined to the terminal electrode 6. However, as shown in FIG. 7A, a plurality of identifiers 81 and 82 may be joined in a juxtaposed manner to the rear end surface 6B of the terminal electrode 6. Also, as shown in FIG. 7B, a plurality of identifiers 91, 92, and 93 may be joined in a layered manner to the rear end surface of the terminal electrode 6. In this case, the amount of information obtained from the identifiers can be easily increased. Also, as compared with the case where the identifier is formed by painting, the identifier can be formed into a more complicated shape and can be formed more easily. In the case where the identifiers are provided in layers, in view of the performance of joining, the total thickness of the identifiers arranged in layers is preferably 1.0 mm or less.

(d) No particular limitation is imposed on the thread diameter of the threaded portion 15 of the spark plug 1. However, the present invention is more useful in application to a spark plug whose threaded portion 15 has a relatively small thread diameter (e.g., M12 or less) in association with reduction in the diameter of the metallic shell 3. That is, in association with reduction in the diameter of the threaded portion 15, the terminal electrode 6 is also reduced in diameter. As a result, the rear end surface of the diameter-reduced terminal electrode 6 has a very small area. Accordingly, the identifier must be reduced in size. In this case, if the identifier is formed by painting, even a small degree of patchy application of paint leads to a relatively great disturbance of the shape of the identifier, potentially resulting in a great deterioration in identifiability of the identifier. By contrast, according to the present invention, which is free from patchy application of paint or a like problem, a great deterioration in identifiability of the identifier can be effectively restrained. In other words, the present invention is particularly useful in application to a spark plug whose threaded portion 15 has a relatively small thread diameter and thus whose terminal electrode 6 has a rear end surface having a relatively small area.

(e) In the embodiments described above, the ground electrode 27 is joined to the front end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(f) In the embodiments described above, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

| | |
|---|---|
| 1: | spark plug |
| 2: | insulator |
| 4: | axial hole |
| 6: | terminal electrode |
| 6B: | rear end surface (of terminal electrode) |
| 31: | identifier |
| 31W: | curved surface portion |
| 61H, 62H, 63H: | counter engagement portion |
| 71E, 72E, 73E: | engagement portion |
| CL1: | axis |

We claim:

1. A spark plug comprising:

an insulator having an axial hole extending in a direction of an axis; and a terminal electrode disposed at a rear end portion of the axial hole, wherein an identifier showing externally visible identification information is joined to a rear end surface of the terminal electrode, and the identifier has a thickness of 0.03 mm or greater along the direction of the axis.

2. A spark plug according to claim 1, wherein the identifier has a thickness of 0.2 mm or greater along the direction of the axis.

3. A spark plug according to claim 1, wherein the identifier is formed of an electrically conductive resin or an electrically conductive rubber.

4. A spark plug according to claim 1, wherein the identifier has a thickness of 1.0 mm or less.

5. A spark plug according to claim 1, wherein the identifier is formed of a metal material.

6. A spark plug according to claim 5, wherein the identifier is formed of a material having a color different from that of the rear end surface of the terminal electrode.

7. A spark plug according to claim 1, wherein the identifier has a resistance of 1.5 kΩ or less as measured between the terminal electrode and a rear surface of the identifier opposite a surface of the identifier joined to the terminal electrode.

8. A spark plug according to claim 1, wherein, when the identifier and the rear end surface of the terminal electrode are projected along the axis onto a plane of projection, as viewed on the plane of projection, an area S1 ($mm^2$) of a projected image of the rear end surface of the terminal electrode and an area S2 ($mm^2$) of a projected image of the identifier satisfy a relation represented by $$0.2 \leqq S2/S1 \leqq 1.0.$$

9. A spark plug according to claim 1, wherein the identifier has a Vickers hardness of 150 Hv or less.

10. A spark plug according to claim 1, wherein, when the identifier is sectioned along the axis, as viewed on the section, the rear surface of the identifier opposite the surface of the identifier joined to the terminal electrode, and a side surface of the identifier extending along the direction of the axis are orthogonal to each other, or the rear surface and the side surface are continuous with each other via a curved surface portion having a radius of curvature of 0.3 mm or less.

11. A spark plug according to claim 1, wherein the identifiers in a quantity of more than one are joined to the rear end surface of the terminal electrode.

12. A spark plug according to claim 7, wherein the identifier has a convex or concave engagement portion provided on the surface of the identifier joined to the terminal electrode;

the terminal electrode has a concave or convex counter engagement portion provided on the rear end surface of the terminal electrode for engagement with the engagement portion; and the identifier is joined to the rear end surface of the terminal electrode in a condition in which the engagement portion is engaged with the counter engagement portion for positioning of the identifier in relation to the rear end surface of the terminal electrode.

13. A method of manufacturing a spark plug according to claim 1, comprising the steps of:

manufacturing the identifier, and joining the identifier to the rear end surface of the terminal electrode.

* * * * *